US008766867B2

(12) United States Patent
Ying

(10) Patent No.: US 8,766,867 B2
(45) Date of Patent: Jul. 1, 2014

(54) COMPACT ANTENNA FOR MULTIPLE INPUT MULTIPLE OUTPUT COMMUNICATIONS INCLUDING ISOLATED ANTENNA ELEMENTS

(75) Inventor: Zhinong Ying, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 335 days.

(21) Appl. No.: 12/969,764

(22) Filed: Dec. 16, 2010

(65) Prior Publication Data

US 2012/0154237 A1 Jun. 21, 2012

(51) Int. Cl.
*H01Q 19/00* (2006.01)

(52) U.S. Cl.
USPC ..... 343/833; 343/700 MS

(58) Field of Classification Search
USPC ..... 343/700 MS
See application file for complete search history.

(56) References Cited

U.S. PATENT DOCUMENTS

| | | | | |
|---|---|---|---|---|
| 7,106,252 | B2 * | 9/2006 | Smith et al. | 343/700 MS |
| 2003/0098812 | A1 * | 5/2003 | Ying et al. | 343/702 |
| 2003/0193437 | A1 | 10/2003 | Kangasvieri et al. | |
| 2007/0001911 | A1 | 1/2007 | Fujio et al. | |
| 2007/0117514 | A1 | 5/2007 | Gainey et al. | |
| 2007/0152887 | A1 * | 7/2007 | Castany et al. | 343/702 |
| 2008/0136734 | A1 | 6/2008 | Manholm et al. | |
| 2008/0218418 | A1 | 9/2008 | Gillette | |
| 2009/0066583 | A1 | 3/2009 | Hung et al. | |
| 2009/0207080 | A1 | 8/2009 | Floyd et al. | |

FOREIGN PATENT DOCUMENTS

WO WO 01/82412 A2 11/2001

OTHER PUBLICATIONS

Ke, Shyh-Yeong, Broadband Proximity-coupled Microstrip Antennas with an H-shaped Slot in the Ground Plane, 2002, IEEE, pp. 530-533.*

European Search Report Corresponding to European Application No. 11188966.3; Dated: Mar. 26, 2012; 7 pages.

Wong K. et al., "Broad-Band Dual-Polarized Patch Antennas Fed by Capacitively Coupled Feed and Slot-Coupled Feed", *IEEE Transactions on Antennas and Propagation*, vol. 50, No. 3, Mar. 2002, pp. 346-351.

Chaff et al., "Broadband Microstrip Patch Antenna Fed by a Novel Coupling Device", PIERS Online, vol. 3, No. 7, Mar. 2007, pp. 1064-1066.

* cited by examiner

*Primary Examiner* — Douglas W Owens
*Assistant Examiner* — Jae Kim
(74) *Attorney, Agent, or Firm* — Myers Bigel Sibley & Sajovec, P.A.

(57) ABSTRACT

An antenna for MIMO communications includes a ground plane having a planar surface, a first feeding patch spaced apart from and parallel to the ground plane, and a first parasitic patch spaced apart from and parallel to the first feeding patch. The antenna further includes a second feeding patch spaced apart from and parallel to the ground plane and disposed adjacent the first feeding patch, and a second parasitic patch spaced apart from and parallel to the second feeding patch. The first parasitic patch may be capacitively coupled to the first feeding patch, and the second parasitic patch may be capacitively coupled to the second feeding patch. The ground plane may include an isolation notch therein arranged between the first and second feeding patches.

13 Claims, 5 Drawing Sheets

COMPACT ANTENNA FOR MULTIPLE INPUT MULTIPLE OUTPUT COMMUNICATIONS INCLUDING ISOLATED ANTENNA ELEMENTS

FIELD OF THE INVENTION

The present invention relates to an antenna for wireless communications, and in particular relates to an antenna for performing multiple input multiple output wireless communications.

BACKGROUND

Wireless communication channels suffer from fading, or loss of signal, due to changes in the propagation environment of the wireless signal. Some types of fading, such as Rayleigh fading, can be highly localized in nature. Furthermore, wireless communication systems are often limited in the amount bandwidth that can be used, due to practical restrictions on the electronics that are used, or due to licensing and regulatory restrictions.

Multiple-input and multiple-output, or MIMO, refers to the use of multiple antennas at the transmitter and the receiver end of a wireless link. MIMO technology may offer significant increases in data throughput and/or transmission range without the need for additional bandwidth or transmit power. It can achieve this due to the ability of MIMO to obtain higher spectral efficiency (more bits per second per hertz of bandwidth) and/or reduced fading.

MIMO based systems allow the use of a variety of coding techniques that take advantage of the presence of multiple transmit and receive antennas. For example, wireless communications performed over a MIMO channel can use beamforming, spatial multiplexing and/or diversity coding techniques.

Beamforming involves transmitting the same signal on each of the transmit antennas with appropriate complex (i.e., gain and phase) weighting such that the signal power is increased at the receiver input. The benefits of beamforming are to increase the signal gain from constructive interference and to reduce the multipath fading effect.

In spatial multiplexing, a high data rate signal is split into multiple lower data rate streams, and each stream is transmitted from a different transmit antenna in the same frequency channel. The receiver separates the received streams and combines the received data streams into a single receive stream, thereby increasing channel capacity.

In diversity coding methods, a single stream is transmitted, but the signal is coded using space-time coding techniques so that the signal emitted from each of the transmit antennas is substantially orthogonal. Diversity coding exploits the independent fading in the multiple antenna links to enhance signal diversity.

To increase performance of a MIMO system, it is desirable for fading on the wireless links between the transmit and receive antennas to be uncorrelated. That is, it is desirable for there to be a low statistical correlation between fading experienced at one antenna and fading experienced at another antenna.

Correlation between antennas can be reduced by causing the antennas to have different polarizations, i.e. sending and receiving signals with orthogonal polarizations. Furthermore, antennas for MIMO systems may utilize spatial separation, or physical separation, to reduce correlation between antennas. Either of these approaches can be unsatisfactory for handheld mobile devices, however, as it is generally desirable for the handheld devices to have compact antennas.

SUMMARY

An antenna according to some embodiments includes a ground plane, a first feeding patch spaced apart from the ground plane, and a first parasitic patch spaced apart from the first feeding patch. The first feeding patch may be between the ground plane and the first parasitic patch, and the first parasitic patch may be coupled to the ground plane by a first ground pin. The first parasitic patch may be capacitively coupled to the first feeding patch. The antenna further includes a second feeding patch spaced apart from the ground plane and disposed adjacent the first feeding patch, and a second parasitic patch spaced apart from the second feeding patch. The second feeding patch may be between the ground plane and the second parasitic patch, and the second parasitic patch may be coupled to the ground plane by a second ground pin. The second parasitic patch may be capacitively coupled to the second feeding patch. The ground plane may include an isolation notch therein arranged between the first and second feeding patches.

The notch may have an H-shape including a center portion that extends in a longitudinal direction between the first and second feeding patches and respective transverse end portions at respective ends of the center portion that are perpendicular to the center portion.

The center portion of the notch may be longer than longitudinal dimensions of the first and second feeding patches along which the center portion extends.

The antenna may further include a third parasitic patch adjacent to and coplanar with the first feeding patch and a fourth parasitic patch adjacent to and coplanar with the second feeding patch. The third parasitic patch may be coupled to the ground plane by a third ground pin, and the fourth parasitic patch may be coupled to the ground plane by a fourth ground pin. The third parasitic patch may have a smaller longitudinal dimension than the first parasitic patch so as to provide a resonant frequency higher than a resonant frequency of the first parasitic patch, and the fourth parasitic patch may have a smaller longitudinal dimension than the second parasitic patch so as to provide a resonant frequency higher than a resonant frequency of the second parasitic patch.

The notch may have an H-shape including a center portion that extends in a longitudinal direction between the first and second feeding patches and respective end portions at respective ends of the center portion that are perpendicular to the center portion.

The first feeding patch, the first parasitic patch and the third parasitic patch define a first antenna having a high resonant frequency and a low band resonant frequency, and the second feeding patch, the second parasitic patch and the fourth parasitic patch define a second antenna having the high band resonant frequency and the low resonant frequency.

A coupling ratio between the first antenna and the second antenna at the low resonant frequency may be about −25 dB or less and a coupling ratio between the first antenna and the second antenna at the high resonant frequency may be about −30 dB or less.

The low band resonant frequency may be about 3 GHz or less, and the high band resonant frequency may be about 5 GHz or more.

In some embodiments, the notch has a length in the longitudinal direction that is equal to about half the wavelength of the low band resonant frequency and the full wavelength of the high band resonant frequency.

The first feeding patch and the second feeding patch are laterally spaced apart from one another by a distance of about 3 mm or less. In some embodiments, the first feeding patch and the second feeding patch are laterally spaced apart from one another by a distance of about 2 mm or less.

The first feeding patch and the first parasitic patch define a first antenna having a resonant frequency and the second feeding patch and the second parasitic patch define a second antenna having the resonant frequency, and a coupling ratio between the first antenna and the second antenna at the resonant frequency may be about −25 dB or less.

A wireless communication device according to some embodiments includes a transceiver including a transmitter and a receiver, and an antenna coupled to the transceiver. The antenna may include a ground plane, a first feeding patch spaced apart from the ground plane, and a first parasitic patch spaced apart from the first feeding patch. The first feeding patch may be between the ground plane and the first parasitic patch, and the first parasitic patch may be coupled to the ground plane by a first ground pin. The first parasitic patch may be capacitively coupled to the first feeding patch. The antenna includes a second feeding patch spaced apart from the ground plane and disposed adjacent the first feeding patch, and a second parasitic patch spaced apart from the second feeding patch. The second feeding patch may be between the ground plane and the second parasitic patch, and the second parasitic patch may be coupled to the ground plane by a second ground pin. The second parasitic patch may be capacitively coupled to the second feeding patch. The ground plane may include an isolation notch therein arranged between the first and second feeding patches.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
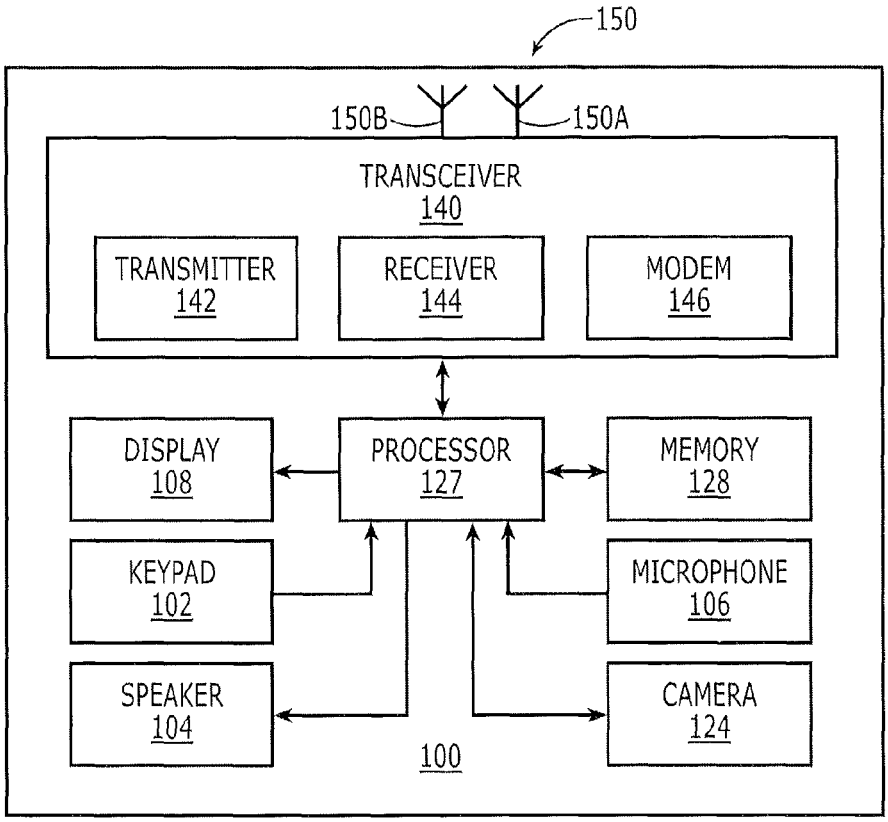
FIG. 1 is a block diagram of a wireless communication device.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

As used herein, a "wireless communication device" includes, but is not limited to, a device that is configured to receive/transmit communication signals via a wireless interface with, for example, a cellular network, a wireless local area network (WLAN), a digital television network such as a DVB-H network, a satellite network, an AM/FM broadcast transmitter, and/or another communication terminal. A wireless communication device may be referred to as a "wireless communication terminal," a "wireless terminal" and/or a "mobile terminal." Examples of wireless communication devices include, but are not limited to, a satellite or cellular radiotelephone; a Personal Communications System (PCS) terminal that may combine a cellular radiotelephone with data processing, facsimile and data communications capabilities; a PDA that can include a radiotelephone, pager, Internet/intranet access, Web browser, organizer, calendar and/or a global positioning system (GPS) receiver; and a conventional laptop and/or palmtop receiver or other appliance that includes a radio transceiver, including WLAN routers and the like.

Wireless communication between electronic devices may be accomplished using a wide variety of communication media, communication systems and communication standards. For example, mobile terminals such as wireless mobile telephones are typically configured to communicate via analog and/or digital wireless radio frequency (RF) telephone systems. Such devices may additionally be configured to communicate using wired and/or wireless local area networks (LANs), short range communication channels, such as Bluetooth RF communication channels and/or infrared communication channels, and/or long range communication systems, such as satellite communication systems.

A wireless communication device 100 according to some embodiments is illustrated in FIG. 1.

In particular, the wireless communication device 100 is configured to transmit and/or receive wireless signals over one or more wireless communication interfaces. For example, a wireless communication device 100 according to some embodiments can include a cellular communication module, a Bluetooth module, an infrared communication module, a global positioning system (GPS) module, a WLAN module, and/or other types of communication modules.

With a cellular communication module, the wireless communication device 100 can communicate using one or more cellular communication protocols such as, for example, Advanced Mobile Phone Service (AMPS), ANSI-136, Global Standard for Mobile (GSM) communication, General Packet Radio Service (GPRS), enhanced data rates for GSM evolution (EDGE), code division multiple access (CDMA), wideband-CDMA, CDMA2000, and Universal Mobile Telecommunications System (UMTS).

With a Bluetooth or infrared module, the wireless communication device 100 can communicate via an ad-hoc network using a direct wireless interface. With a WLAN module, the wireless communication device 100 can communicate through a WLAN router using a communication protocol that may include, but is not limited to, 802.11a, 802.11b, 802.11e, 802.11g, and/or 802.11i.

A wireless communication device 100 my additionally include an AM/FM radio tuner, a UHF/VHF tuner, a satellite radio tuner, a DVB-H receiver, and/or another receiver configured to receive a broadcast audio/video signal and/or data signal.

The wireless communication device 100 includes a display 108, such as a liquid crystal display (LCD) and/or an organic light emitting diode (OLED) display. The wireless communication device 100 may optionally include a keypad 102 or other user input mechanism on the front housing 110 of the device 100. In some embodiments, the display 108 may be provided with touchscreen capability to replace and/or supplement the keypad 102.

The wireless communication device 100 may include a microphone 106 and an earphone/speaker 104. The front housing 110 may be designed to form an acoustic seal to the user's ear when the earphone/speaker 104 is placed against the user's head.

The keypad 102, display 108, microphone 106, speaker 104 and camera 124 may be coupled to a processor 127, such as a microprocessor or microcontroller, which may be configured to control operations of the device 100. The device 100 may further include a transceiver 140 and a memory 128 coupled to the processor 127. Other electronic circuitry, such as a WLAN communication interface, a Bluetooth interface, a GPS interface, a digital signal processor, etc., may also be included in the electronic circuitry of the device 100.

The transceiver 140 typically includes a transmitter circuit 142, a receiver circuit 144, and a modem 146, which cooperate to transmit and receive radio frequency signals to remote transceivers via an antenna array 150 including at least a first antenna 150A and a second antenna 150B. The antenna array 150 can include more than two antennas 150A, 150B The radio frequency signals transmitted between the device 100 and the remote transceivers may comprise both traffic and control signals (e.g., paging signals/messages for incoming calls), which are used to establish and maintain communication with another party or destination.

The memory 128 may be a general purpose memory that is used to store both program instructions for the processor 127 as well as data, such as audio data, video data, configuration data, and/or other data that may be accessed and/or used by the processor 127. The memory 128 may include a nonvolatile read/write memory, a read-only memory and/or a volatile read/write memory. In particular, the memory 128 may include a read-only memory in which basic operating system instructions are stored, a non-volatile read/write memory in which re-usable data, such as configuration information, directory information, and other information may be stored, as well as a volatile read/write memory, in which short-term instructions and/or temporary data may be stored.

Figure 2:
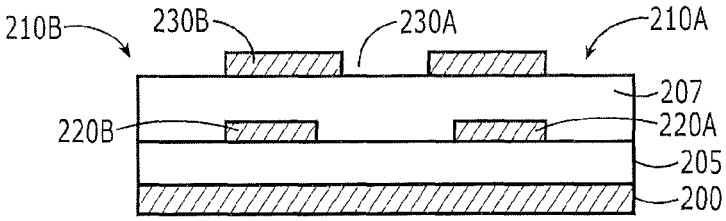
FIGS. 2, 3, 4 and 5 illustrate an antenna structure including two coupling fed patch antennas on a ground plane of a wireless communication device according to some embodiments.
Figure 3:
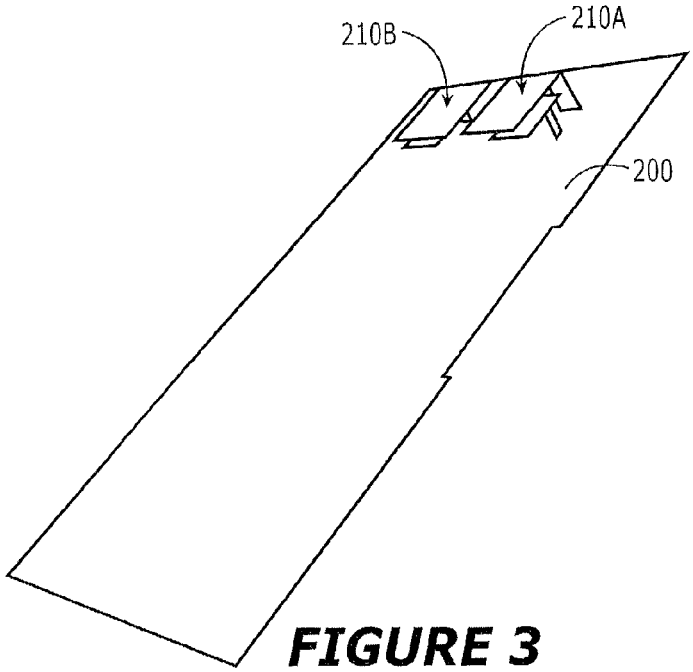
Figure 4:
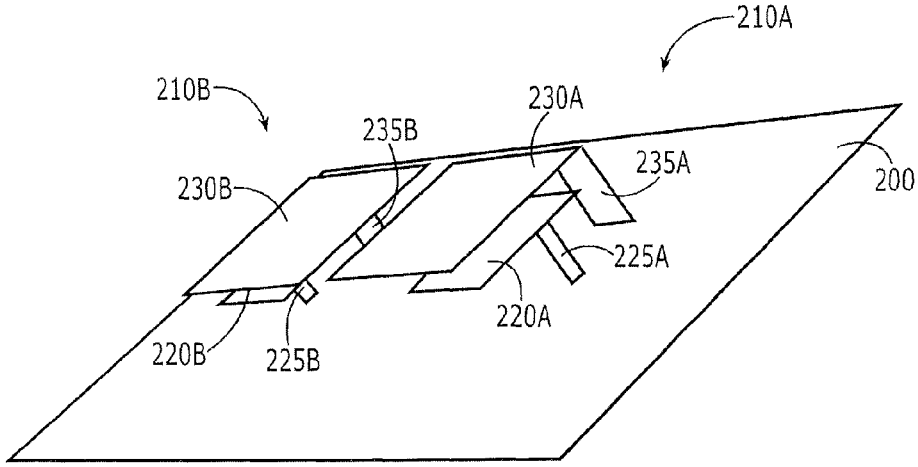
Figure 5:
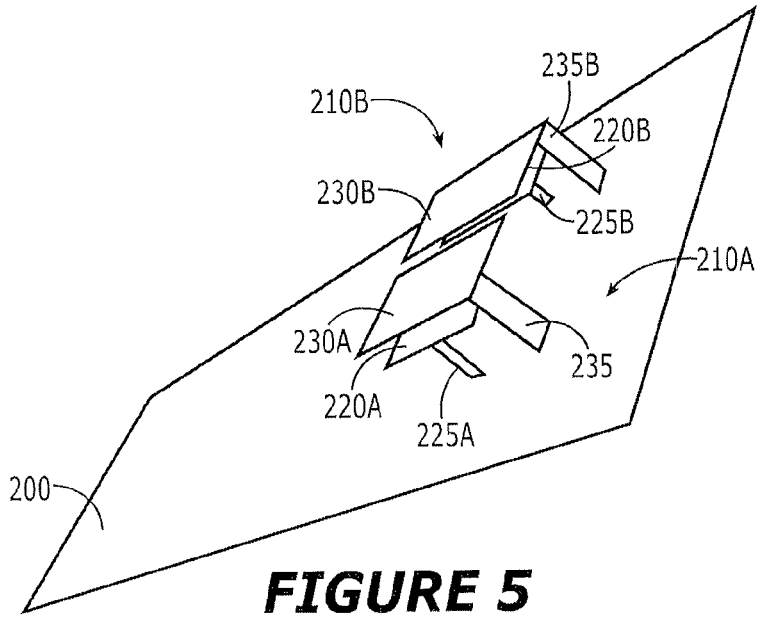

FIGS. 2, 3, 4 and 5 illustrate an antenna structure including two coupling fed patch antennas 210A, 210B on a ground plane 200. In particular, FIG. 2 is a cross section of an antenna including two coupling fed patch antennas 210A, 210B on a ground plane 200, while FIGS. 3, 4 and 5 are perspective views of an antenna according to some embodiments.

The ground plane 200 may, for example, be a ground plane of a printed wiring board (PWB) or it may comprise a separate conductive sheet. The antenna structure may be incorporated within or on a wireless communication device 100 according to some embodiments.

Each of the coupling fed patch antennas 210A, 210B includes a feeding patch 220A, 220B that is coupled to external transmit/receive circuitry (not shown) by a respective feeding pin 225A, 225B. Each of the feeding patches 220A, 220B comprises a conductive sheet, such as a metal strip or patch, that is parallel to and spaced apart from the ground plane 200.

The feeding patches 220A, 220B may be spaced apart from the ground plane 200 by a dielectric substrate 205. In some embodiments, the feeding patches 220A, 220B and the ground plane 200 may be printed on opposite sides of the dielectric substrate 205. In some embodiments, the dielectric substrate 205 may have a relative dielectric constant of about 2 to 6 and in some cases 2 to 4 and a thickness of about 2 to 4 mm. Furthermore, the feeding patches 220A, 220B may have a longitudinal dimension (i.e., in a direction extending away from the feeding pin 225A, 225B), of about 10 mm, which corresponds to a quarter wavelength of a resonant frequency of the antenna.

The antenna structure further includes a pair of parasitic patches 230A, 230B that are parallel to the ground plane 200 and to the feeding patches 220A, 220B. The parasitic patches 230A, 230B may be spaced above the feeding patches 220A, 220B, such that the feeding patches 220A, 220B are between the parasitic patches 230A, 230B and the ground plane 200. The parasitic patches 230A, 230B may have lateral and longitudinal dimensions that are larger than the corresponding dimensions of the feeding patches 220A, 220B such that the parasitic patches 230A, 230B completely overlap the feeding patches 220A, 220B when viewed in a direction perpendicular to the plane of the ground plane 200.

The parasitic patches 230A, 230B may be spaced apart from and parallel to the feeding patches 220A, 220B. In some embodiments, the parasitic patches 230A, 230B may be spaced apart from the feeding patches 220A, 220B by a low dielectric material, such as a material having a relatively low dielectric constant of about 2 or less and a thickness of about 2 mm. The parasitic patches 230A, 230B may have a longitudinal dimension (i.e., in a direction extending away from the grounding pins) of about 20 mm.

The feeding patches 220A, 22B may be capacitively coupled to the respective parasitic patches 230A, 230B. Capacitive coupling between the feeding patches 220A, 22B and the respective parasitic patches 230A, 230B may cause the electric field generated by the antenna to be concentrated between the feeding patches and the parasitic patches. This concentration of the field may reduce current on the ground plane, potentially resulting in less coupling between the antennas 210A, 210B.

Each of the parasitic patches 230A, 230B may be grounded to the ground plane 200 by a respective grounding pin 235A, 235B.

Figure 6:
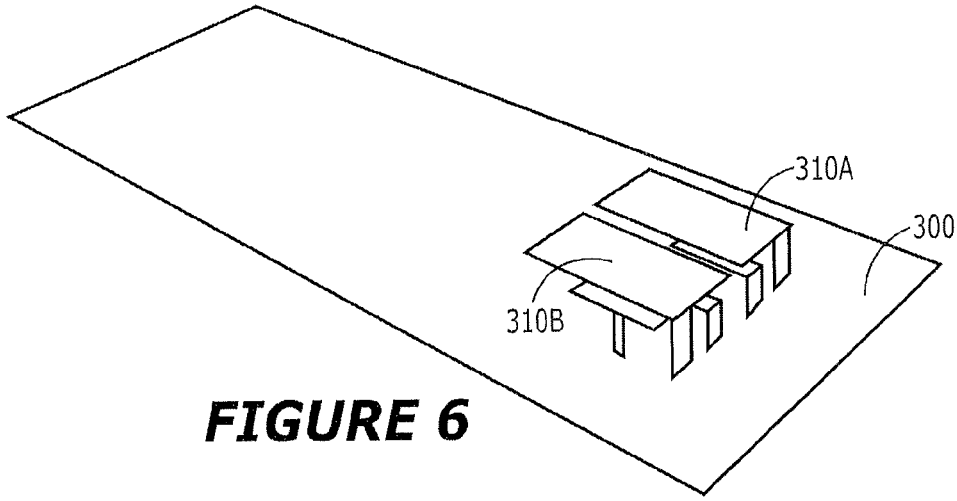
FIGS. 6 and 7 illustrate a dual band antenna structure including two coupling fed patch antennas on a ground plane of a wireless communication device according to further embodiments.
Figure 7:
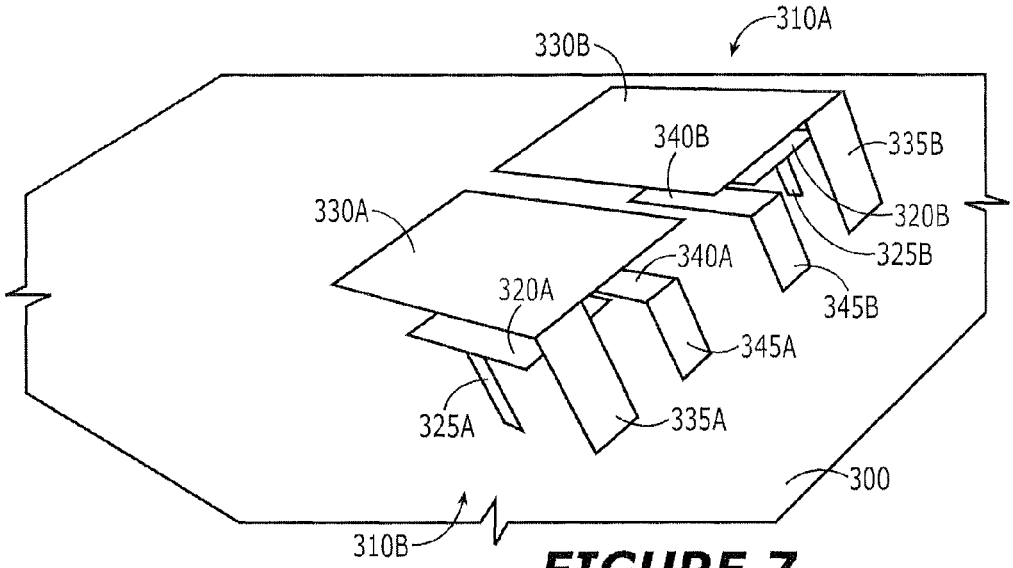

FIGS. 6 and 7 illustrate a dual band antenna structure for MIMO communications including two coupling fed patch antennas 310A, 310B on a ground plane 300 of a wireless communication device according to further embodiments.

Each of the coupling fed patch antennas 310A, 310B includes a feeding patch 320A, 320B that is coupled to external transmit/receive circuitry (not shown) by a respective feeding pin 325A, 325B. Each of the feeding patches 320A, 320B comprises a conductive sheet, such as a metal strip or patch, that is parallel to and spaced apart from the ground plane 300.

The feeding patches 320A, 320B may be spaced apart from the ground plane 300 by a dielectric substrate (not shown). In some embodiments, the feeding patches 320A, 320B and the ground plane 300 may be printed on opposite sides of the dielectric substrate. In some embodiments, the dielectric substrate may have a relative dielectric constant of about 2 to 6, and in some embodiments 2 to 4, and a thickness of about 2 to 4 mm. Furthermore, the feeding patches 320A, 320B may have a longitudinal dimension (i.e., in a direction extending away from the feeding pin 325A, 325B), of about 10 mm, which corresponds to a quarter wavelength of a resonant frequency of the antenna.

The antenna structure further includes a pair of low-band parasitic patches 330A, 330B that are parallel to the ground plane 300 and to the feeding patches 320A, 320B. The parasitic patches 330A, 330B may be spaced above the feeding patches 320A, 320B, such that the feeding patches 320A, 320B are between the low-band parasitic patches 330A, 330B and the ground plane 300. The low-band parasitic patches 330A, 330B may have lateral and longitudinal dimensions that are larger than the corresponding dimensions of the feeding patches 320A, 320B such that the low-band parasitic patches 330A, 330B completely overlap the feeding patches 320A, 320B when viewed in a direction perpendicular to the plane of the ground plane 300.

The low-band parasitic patches 330A, 330B may be spaced apart from and parallel to the feeding patches 320A, 320B. In some embodiments, the low-band parasitic patches 330A, 330B may be spaced apart from the feeding patches 320A, 320B by a low dielectric material, such as a material having a relative dielectric constant of about 2 or less and a thickness of about 2 mm. The low-band parasitic patches 330A, 330B may have a longitudinal dimension of about 20 mm.

Each of the low-band parasitic patches 330A, 330B may be grounded to the ground plane 300 by a respective grounding pin 335A, 335B.

Each of the patch antennas 310A, 310B further includes a respective high-band parasitic patch 340A, 340B that is parallel to and coplanar with the feeding patches 320A, 320B. The high-band parasitic patches 340A, 340B are grounded to the ground plane 300 by respective grounding pins 345A, 345B. The high-band parasitic patches 340A, 340B may have a longitudinal dimension (i.e., in a direction extending away from the grounding pins) of about 12 mm. By providing both high-band and low-band parasitic patches, the patch antennas 310A, 310B may have multiple resonant frequencies, so that the antennas can be used for dual-band communications. The dimensions of the feeding patches 320A, 320B, the high-band parasitic patches 340A, 340B and the low-band parasitic patches 330A, 330B may be selected using well known RF analysis techniques to provide desired resonant frequencies.

Figure 8:
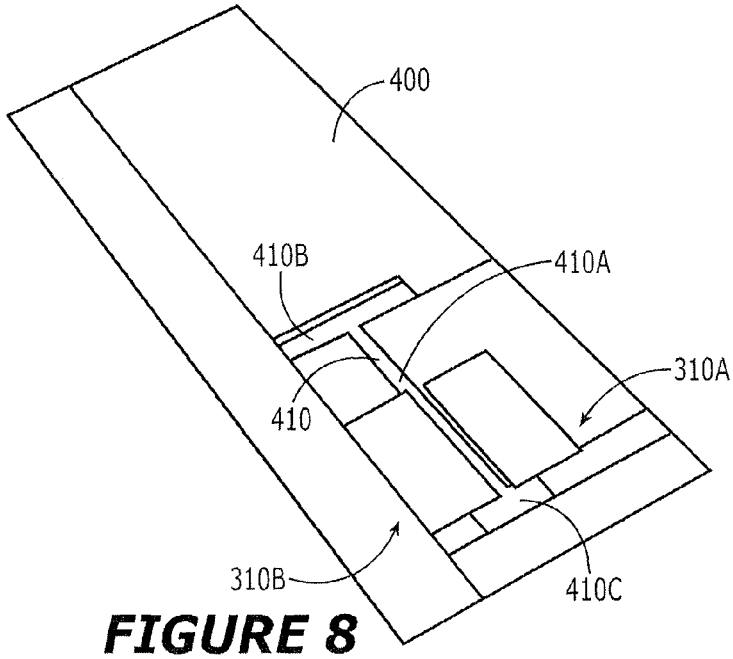
FIG. 8 illustrates a ground plane according to some embodiments including an H-shaped notch therein that is configured to isolate two coupling fed patch antennas according to some embodiments.

FIG. 8 illustrates a ground plane according to some embodiments including a notch 410 therein that is configured to isolate two coupling fed patch antennas 310A, 310B according to some embodiments. In some embodiments, the notch 410 has an H-shape including a longitudinal center portion 410A and transverse portions 410B, 410C at opposite ends of the longitudinal center portion 410A. The longitudinal center portion 410A extends in a longitudinal direction between the coupling fed patch antennas 310A, 310B. The longitudinal center portion 410A may have a length in the longitudinal direction of about 20 mm to about 30 mm, while the transverse portions 410B, 410C may have lengths in the transverse direction of about 10 mm to about 20 mm.

The longitudinal center portion 410A may be longer than lengths of the first and second feeding patches 320A, 320B along which the longitudinal center portion 410A extends.

The longitudinal center portion 410A and the transverse portions 410B, 410C may have widths of about 1 to 2 mm. As illustrated in FIG. 8, the patch antennas 310A, 310B may be offset towards one end of the longitudinal center portion 410A so that the longitudinal center portion 410A extends by about 10 to 20 mm from one end of the patch antennas 310A, 310B.

In some embodiments, the H-shaped notch 410 may have a total length in the longitudinal direction that is equal to about half the wavelength of the low band frequency and the full wavelength of the high band frequency.

Figure 9:
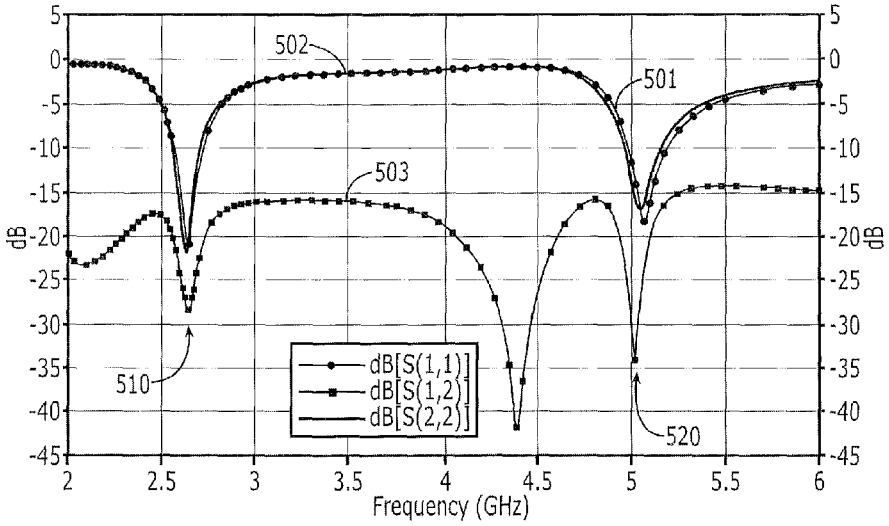
FIG. 9 is a plot of S11, S22 and S12 parameters of a dual band antenna structure including two coupling fed patch antennas on a ground plane of a wireless communication device according to some embodiments.

FIG. 9 is a plot of the S11, S22 and S12 S-parameters of a dual band antenna structure including two coupling fed patch antennas on a ground plane of a wireless communication device including an H-shaped notch as described above with respect to FIGS. 6, 7 and 8 according to some embodiments.

S-parameters, or scattering parameters, are used in RF analysis to characterize the amount of energy flowing into and out of various ports in an RF circuit. For a two-port circuit such as an antenna structure including two coupling fed patch antennas, the S12 parameter is a coupling ratio that provides a measure of the isolation between the two antenna ports at a given frequency, while the S11 and S22 parameters represent a measure of the reflection or absorption of waves at a given frequency. Thus, for example, at the resonant frequencies of the antenna illustrated in FIG. 9 (i.e., about 2.6 GHz and 5 GHz), the S11 and S22 parameters are very small (e.g., less than −15 dB). Furthermore, at these frequencies, the S12 parameter is very small (e.g., less than −20 dB), which indicates that the antennas are well isolated. In particular, the coupling ratio between antennas 310A, 310B at the low resonant frequency may be about −25 dB or less, while the coupling ratio between the antennas at the high resonant frequency may be about −30 dB or less.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. An antenna, comprising:

a ground plane;

a first feeding patch spaced apart from the ground plane;

a first parasitic patch spaced apart from and adjacent to the first feeding patch and capacitively coupled to the first feeding patch, wherein the first feeding patch is between the ground plane and the first parasitic patch, and wherein the first parasitic patch is coupled to the ground plane by a first ground pin;

a second feeding patch spaced apart from the ground plane and disposed adjacent the first feeding patch; and a second parasitic patch spaced apart from and parallel to the second feeding patch and capacitively coupled to the second feeding patch, wherein the second feeding patch is between the ground plane and the second parasitic patch, and wherein the second parasitic patch is coupled to the ground plane by a second ground pin;

wherein the ground plane comprises a notch therein arranged between the first and second feeding patches and configured to increase electrical isolation between patch antennas formed by the first and second feeding patches; and wherein the notch has an H-shape including a center portion that extends in a longitudinal direction between the first and second feeding patches and respective first and second transverse end portions at respective ends of the center portion and that are perpendicular to the center portion, wherein the center portion is longer than lengths of the first and second feeding patches along which the center portion extends, wherein the first transverse end portion is shorter than the second transverse end portion, and wherein the first and second feeding patches are offset in the longitudinal direction towards the first transverse end portion.

2. An antenna, comprising:

a ground plane;

a first feeding patch spaced apart from the ground plane;

a first parasitic patch spaced apart from and adjacent to the first feeding patch and capacitively coupled to the first feeding patch, wherein the first feeding patch is between the ground plane and the first parasitic patch, and wherein the first parasitic patch is coupled to the ground plane by a first ground pin;

a second feeding patch spaced apart from the ground plane and disposed adjacent the first feeding patch; and a second parasitic patch spaced apart from and parallel to the second feeding patch and capacitively coupled to the second feeding patch, wherein the second feeding patch is between the ground plane and the second parasitic patch, and wherein the second parasitic patch is coupled to the ground plane by a second ground pin;

wherein the ground plane comprises a notch therein arranged between the first and second feeding patches;

wherein the notch has an H-shape including a center portion that extends in a longitudinal direction between the first and second feeding patches and respective first and second transverse end portions at respective ends of the center portion and that are perpendicular to the center portion;

wherein the center portion of the notch is longer than longitudinal dimensions of the first and second feeding patches along which the center portion extends; and wherein the center portion is longer than lengths of the first and second feeding patches along which the center portion extends, wherein the first transverse end portion is shorter than the second transverse end portion, and wherein the first and second feeding patches are offset in the longitudinal direction towards the first transverse end portion.

3. The antenna of claim 1, further comprising:

a third parasitic patch adjacent to and coplanar with the first feeding patch, wherein the third parasitic patch is coupled to the ground plane by a third ground pin; and a fourth parasitic patch adjacent to and coplanar with the second feeding patch, wherein the fourth parasitic patch is coupled to the ground plane by a fourth ground pin;

wherein the third parasitic patch has a smaller longitudinal dimension than the first parasitic patch so as to provide a first resonant frequency that is higher than a second resonant frequency of the first parasitic patch, and the fourth parasitic patch has a smaller longitudinal dimension than the second parasitic patch so as to provide a third resonant frequency that is higher than a fourth resonant frequency of the second parasitic patch.

4. The antenna of claim 2, wherein the first feeding patch, the first parasitic patch and the third parasitic patch define a first antenna having the first resonant frequency and the second resonant frequency, and wherein the second feeding patch, the second parasitic patch and the fourth parasitic patch define a second antenna having the third resonant frequency and the fourth resonant frequency.

5. The antenna of claim 4, wherein a coupling ratio between the first antenna and the second antenna at the low resonant frequency is about −25 dB or less and a coupling ratio between the first antenna and the second antenna at the high resonant frequency is about −30 dB or less.

6. The antenna of claim 4, wherein the low resonant frequency is about 3 GHz or less, and the high resonant frequency is about 5 GHz or more.

7. The antenna of claim 1, wherein the first feeding patch and the second feeding patch are laterally spaced apart from one another by a distance of about 3 mm or less.

8. The antenna of claim 7, wherein the first feeding patch and the second feeding patch are laterally spaced apart from one another by a distance of about 2 mm or less.

9. The antenna of claim 1, wherein the first feeding patch and the first parasitic patch define a first antenna having a resonant frequency and wherein the second feeding patch and the second parasitic patch define a second antenna having the resonant frequency, and wherein a coupling ratio between the first antenna and the second antenna at the resonant frequency is about −25 dB or less.

10. A wireless communication device, comprising:

a transceiver comprising a transmitter and a receiver, and an antenna coupled to the transceiver, the antenna including a ground plane, a first feeding patch spaced apart from the ground plane, a first parasitic patch spaced apart from the first feeding patch, wherein the first feeding patch is between the ground plane and the first parasitic patch and is capacitively coupled to the first feeding patch, and wherein the first parasitic patch is coupled to the ground plane by a first ground pin, a second feeding patch spaced apart from the ground plane and disposed adjacent the first feeding patch, and a second parasitic patch spaced apart from the second feeding patch, wherein the second feeding patch is between the ground plane and the second parasitic patch and is capacitively coupled to the second feeding patch, wherein the second parasitic patch is coupled to the ground plane by a second ground pin, and wherein the ground plane comprises a notch therein arranged between the first and second feeding patches and configured to increase electrical isolation between patch antennas formed by the first and second feeding patches; and wherein the notch has an H-shape including a center portion that extends in a longitudinal direction between the first and second feeding patches and respective first and second end portions at respective ends of the center portion and that are perpendicular to the center portion, wherein the center portion is longer than lengths of the first and second feeding patches along which the center portion extends, wherein the first transverse end portion is shorter than the second transverse end portion, and wherein the first and second feeding patches are offset in the longitudinal direction towards the first transverse end portion.

11. A wireless communication device, comprising:

a transceiver comprising a transmitter and a receiver, and an antenna coupled to the transceiver, the antenna including a ground plane, a first feeding patch spaced apart from the ground plane, a first parasitic patch spaced apart from the first feeding patch, wherein the first feeding patch is between the ground plane and the first parasitic patch and is capacitively coupled to the first feeding patch, and wherein the first parasitic patch is coupled to the ground plane by a first ground pin, a second feeding patch spaced apart from the ground plane and disposed adjacent the first feeding patch, and a second parasitic patch spaced apart from the second feeding patch, wherein the second feeding patch is between the ground plane and the second parasitic patch and is capacitively coupled to the second feeding patch, wherein the second parasitic patch is coupled to the ground plane by a second ground pin, and wherein the ground plane comprises a notch therein arranged between the first and second feeding patches; and wherein the notch has an H-shape including a center portion that extends in a longitudinal direction between the first and second feeding patches and respective first and second end portions at respective ends of the center portion and that are perpendicular to the center portion; and wherein the center portion of the notch is longer than longitudinal dimensions of the first and second feeding patches along which the center portion extends;

wherein the center portion is longer than lengths of the first and second feeding patches along which the center portion extends, wherein the first transverse end portion is shorter than the second transverse end portion, and wherein the first and second feeding patches are offset in the longitudinal direction towards the first transverse end portion.

12. The wireless communication device of claim 10, further comprising:

a third parasitic patch adjacent to and coplanar with the first feeding patch, wherein the third parasitic patch is coupled to the ground plane by a third ground pin; and a fourth parasitic patch adjacent to and coplanar with the second feeding patch, wherein the fourth parasitic patch is coupled to the ground plane by a fourth ground pin;

wherein the third parasitic patch has a smaller longitudinal dimension than the first parasitic patch so as to provide a first resonant frequency higher than a second resonant frequency of the first parasitic patch, and the fourth parasitic patch has a smaller longitudinal dimension than the second parasitic patch so as to provide a third resonant frequency higher than a fourth resonant frequency of the second parasitic patch.

13. The wireless communication device of claim 12, wherein the notch extends in a longitudinal direction between the first and second feeding patches and has a length in the longitudinal direction that is equal to about half the wavelength of the second resonant frequency and the full wavelength of the first resonant frequency.

* * * * *